US008602709B2

(12) United States Patent
Habegger

(10) Patent No.: US 8,602,709 B2
(45) Date of Patent: Dec. 10, 2013

(54) AUTOMATIC PARKING LOT

(76) Inventor: Virgile Habegger, Savigny (CH)

( * ) Notice: Subject to any disclaimer, the term of this patent is extended or adjusted under 35 U.S.C. 154(b) by 686 days.

(21) Appl. No.: 12/066,016

(22) PCT Filed: Sep. 5, 2006

(86) PCT No.: PCT/IB2006/002436

§ 371 (c)(1),
(2), (4) Date: Mar. 6, 2008

(87) PCT Pub. No.: WO2007/029092

PCT Pub. Date: Mar. 15, 2007

(65) Prior Publication Data

US 2008/0273952 A1 Nov. 6, 2008

(30) Foreign Application Priority Data

Sep. 7, 2005 (FR) ..... 05 09123

(51) Int. Cl.
*E04H 6/00* (2006.01)

(52) U.S. Cl.
USPC ..... 414/238

(58) Field of Classification Search
USPC ..... 414/233, 236, 237, 238; 104/172.3
See application file for complete search history.

(56) References Cited

U.S. PATENT DOCUMENTS 1,869,743 A * 8/1932 Geiger ..... 414/242
2,899,086 A 8/1959 Thaon de Saint-Andre
3,040,913 A 6/1962 Foster, Jr. et al.
3,115,257 A * 12/1963 Kubik ..... 414/235
3,352,436 A 11/1967 Lc Vesconte et al.
3,390,791 A * 7/1968 Baldwin et al. ..... 414/347
3,517,836 A * 6/1970 Bosco ..... 414/234
3,570,687 A 3/1971 Toedtli
3,677,190 A * 7/1972 Koch ..... 104/172.3
4,718,349 A * 1/1988 Wahren ..... 104/165
4,768,914 A * 9/1988 Sing ..... 414/237
4,804,305 A * 2/1989 Lapotaire ..... 414/233
4,874,280 A * 10/1989 Gamberini ..... 414/234
5,066,187 A * 11/1991 Hammer ..... 414/237
5,067,414 A * 11/1991 Moore et al. ..... 104/172.2
2,641,020 A 3/1992 Jung
5,098,246 A * 3/1992 Jung ..... 414/239

(Continued)

FOREIGN PATENT DOCUMENTS

FR 2 641 020 A 9/1990
FR 2 700 354 A 7/1994

(Continued)

OTHER PUBLICATIONS

International Search Report for International Application No. PCT/IB2006/002436 mailed Jan. 15, 2007.

*Primary Examiner* — Joshua Rudawitz
(74) *Attorney, Agent, or Firm* — Frommer Lawrence & Haug LLP; Ronald R. Santucci

(57) ABSTRACT

The invention concerns a parking lot at least partly automatic comprising at least one floor (1; 1*a*, 1*b*) including parking lanes (4) separated by lateral boundaries (5), characterized in that each parking lane (4) comprises one or more driving means (7) to drive a vehicle in the longitudinal direction up to a free place and in that the entry and exit ends of the parking lanes (4) are connected to transport means (8, 9) allowing the automatic entry and exit of the vehicles in and out of the parking lanes (4).

15 Claims, 10 Drawing Sheets

(56) References Cited

U.S. PATENT DOCUMENTS

| | | | | |
|---|---|---|---|---|
| 5,109,642 | A * | 5/1992 | Ayala et al. | 52/79.1 |
| 5,140,910 | A * | 8/1992 | Welter | 104/172.3 |
| 5,165,842 | A * | 11/1992 | Hammer | 414/800 |
| 5,190,427 | A * | 3/1993 | Lai | 414/278 |
| 5,338,143 | A * | 8/1994 | Matsuda et al. | 414/142.1 |
| 5,678,972 | A | 10/1997 | Bockler et al. | |
| 6,328,521 | B1 * | 12/2001 | Givati | 414/234 |
| 6,554,127 | B1 * | 4/2003 | Kroll | 198/465.4 |
| 6,677,548 | B2 * | 1/2004 | Robu et al. | 209/583 |
| 7,708,514 | B2 * | 5/2010 | Benedict et al. | 414/142.6 |
| 2007/0028796 | A1 * | 2/2007 | Lin | 104/172.3 |

FOREIGN PATENT DOCUMENTS

| | | | |
|---|---|---|---|
| GB | 410 950 | A | 5/1934 |
| JP | 11-350773 | A | 12/1999 |
| WO | WO 98/25839 | A | 6/1998 |

* cited by examiner

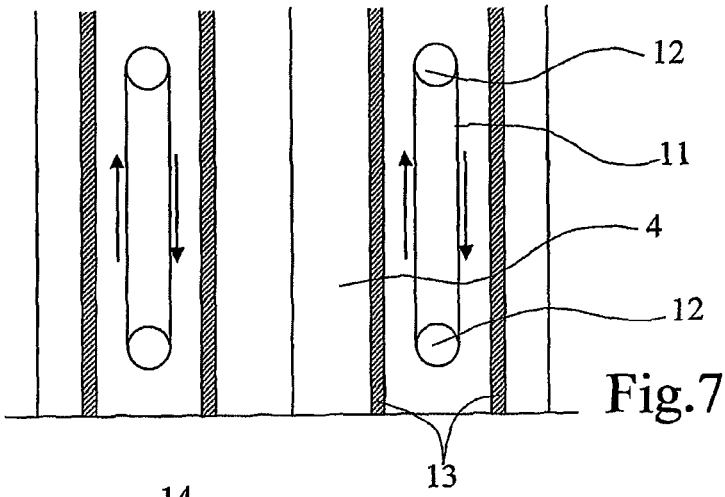
Fig.7
Fig.8
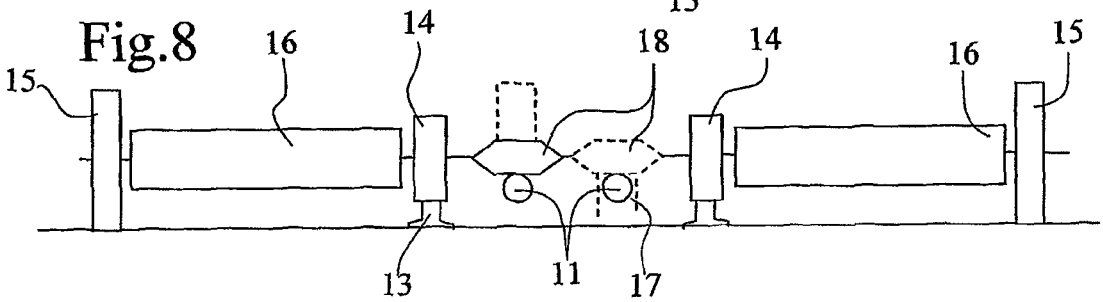
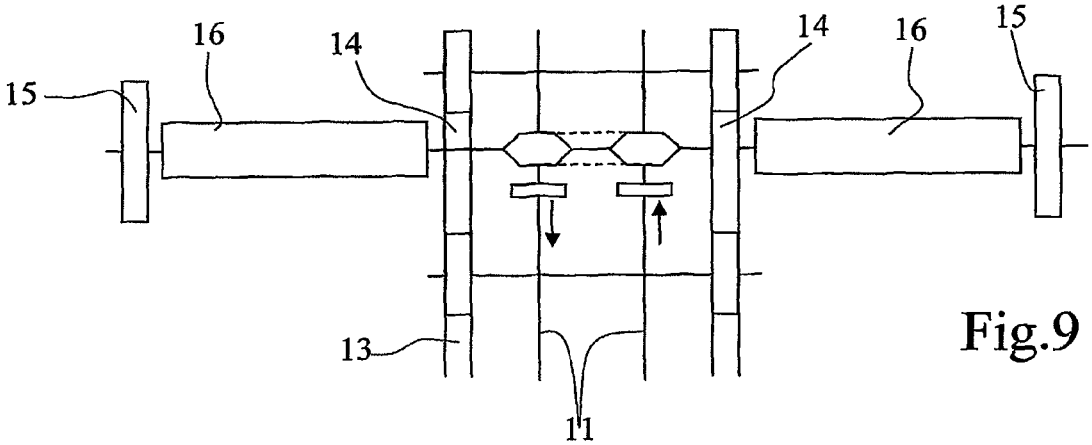
Fig.9
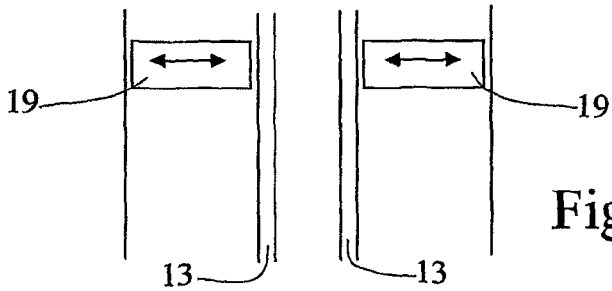
Fig.10

AUTOMATIC PARKING LOT

This application is a 371 of PCT/IB2006/002436 filed on Sep. 5, 2006, published on Mar. 15, 2007 under publication number WO 2007/029092 A1 which claims priority benefits from French Patent Application Number 05 09123 filed Sep. 7, 2005, the disclosure of which is incorporated herein by reference.

BACKGROUND OF THE INVENTION

The invention relates to a parking garage that is at least partially automatic making it possible to park a plurality of vehicles in a restricted volume.

Conventional, nonautomatic parking garages consist of parking spaces that can be accessed via a roadway traveled by the vehicle being driven by its driver. These spaces can all be accessed via roadways which represent a considerable proportion of the total surface area of the garage. In addition, a sufficient clearance has to be provided around each space to allow a vehicle to maneuver and position itself easily, while allowing its driver to get out of his vehicle. The disadvantage of these parking garages therefore arises from the fact that a very considerable surface area is reserved for accessing the various parking spaces and cannot be directly used for parking vehicles.

To remedy these disadvantages, there are automatic parking garages in which a driver positions his vehicle at an entrance point, this vehicle then being conducted automatically to its parking space.

A first solution is described in document FR2641020, in which a driver positions his vehicle at the entrance in a vertical elevator. This elevator, that can be moved horizontally, is then capable of positioning the vehicle in its final parking space, in the chosen column and at the chosen height. The vehicle is released in a similar manner via the elevator. The first disadvantage of this solution is its cost due to the use of a complex elevator. In addition, the total number of parking spaces remains limited since the garage is limited to a two-dimensional vertical geometry.

Document FR27000354 proposes a parking garage on a horizontal surface in which each vehicle is positioned on a platform that can be moved transversely. The first disadvantage of this solution is that the garage is limited to a two-dimensional horizontal geometry. Its second disadvantage is its complexity and its high cost since each vehicle is positioned on an independent movable platform. A third disadvantage arises from the nonoptimization of the available surface area: specifically, an entire row must always be free for allowing access to the most distant spaces, and in addition each row must have a width compatible with the longest vehicle admitted to park: a considerable surface area not occupied by the shortest vehicles remains unused.

Document U.S. Pat. No. 5,678,972 describes a three-dimensional garage solution based on a combination of horizontal platforms and elevators as in the preceding solutions. This solution, although three-dimensional, combines the other disadvantages mentioned above.

Finally, document U.S. Pat. No. 3,040,913 describes an automatic car park in which vehicles enter through an entrance where they are positioned on a platform and raised to a predefined floor by a first elevator. The placement on the chosen floor is carried out from a choice of several parking lines. The exit is similar, via a second elevator. All the movements of the platforms supporting the vehicles are made by automatic driving means. One disadvantage of this solution arises from the fact that two elevators are necessary, one for the entrance and the other for the exit. Furthermore, a second disadvantage arises from the fact that all the vehicle movements are carried out by means of a movable platform on which the vehicle is parked, which induces a costly infrastructure.

BRIEF SUMMARY OF THE INVENTION

The object of the present invention consists in proposing an at least partially automatic parking garage that does not have the foregoing disadvantages.

More precisely, a first subject of the present invention consists in a parking garage that optimizes the available surface area and makes it possible to park a maximum of vehicles in the smallest volume.

A second subject of the present invention consists in a parking garage that is simple and low cost.

A third subject of the present invention is a parking garage that is compatible with a three-dimensional dimension.

A fourth subject of the present invention consists in a method of access to a space or to a vehicle in a space in a parking garage.

The invention achieves the above aims by proposing a parking garage that is at least partially automatic, comprising at least one floor comprising parking lanes separated by lateral limits, characterized in that each parking lane comprises a driving means for directly driving the wheels of a vehicle in order to move the vehicle in the longitudinal direction up to a free space and in that the entrance and/or exit ends of the parking lanes are connected to a transport means consisting in one or more platforms traveling on rails allowing the vehicles to automatically enter and exit the parking lanes, at least one floor being at least partially surrounded by rails.

The invention is more precisely defined by the claims.

BRIEF DESCRIPTION OF THE DRAWINGS

These subjects, features and advantages of the present invention will be explained in detail in the following description of a particular embodiment made in a nonlimiting manner with reference to the attached figures amongst which:

DETAILED DESCRIPTION OF THE INVENTION

Figure 1:
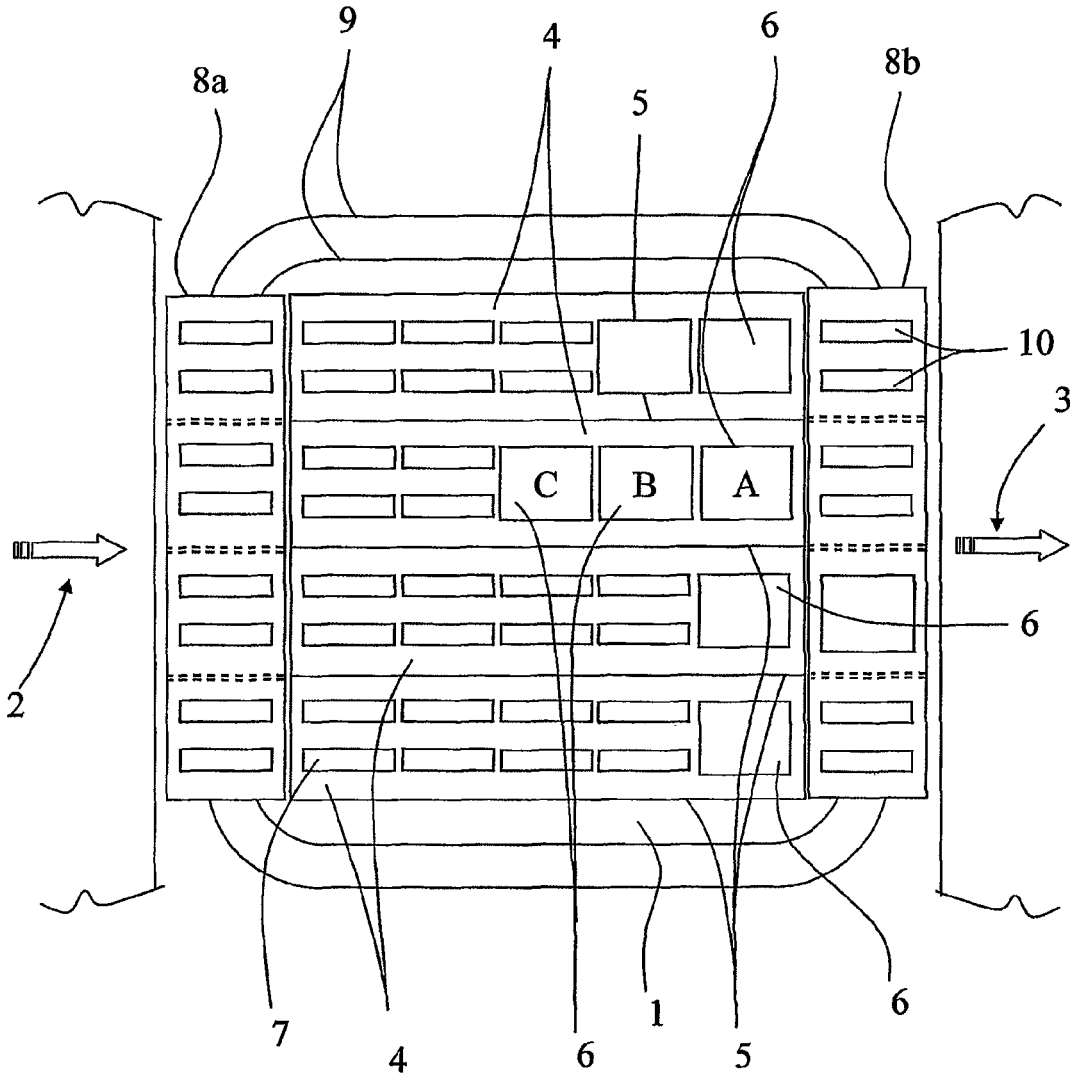
Figure 2:
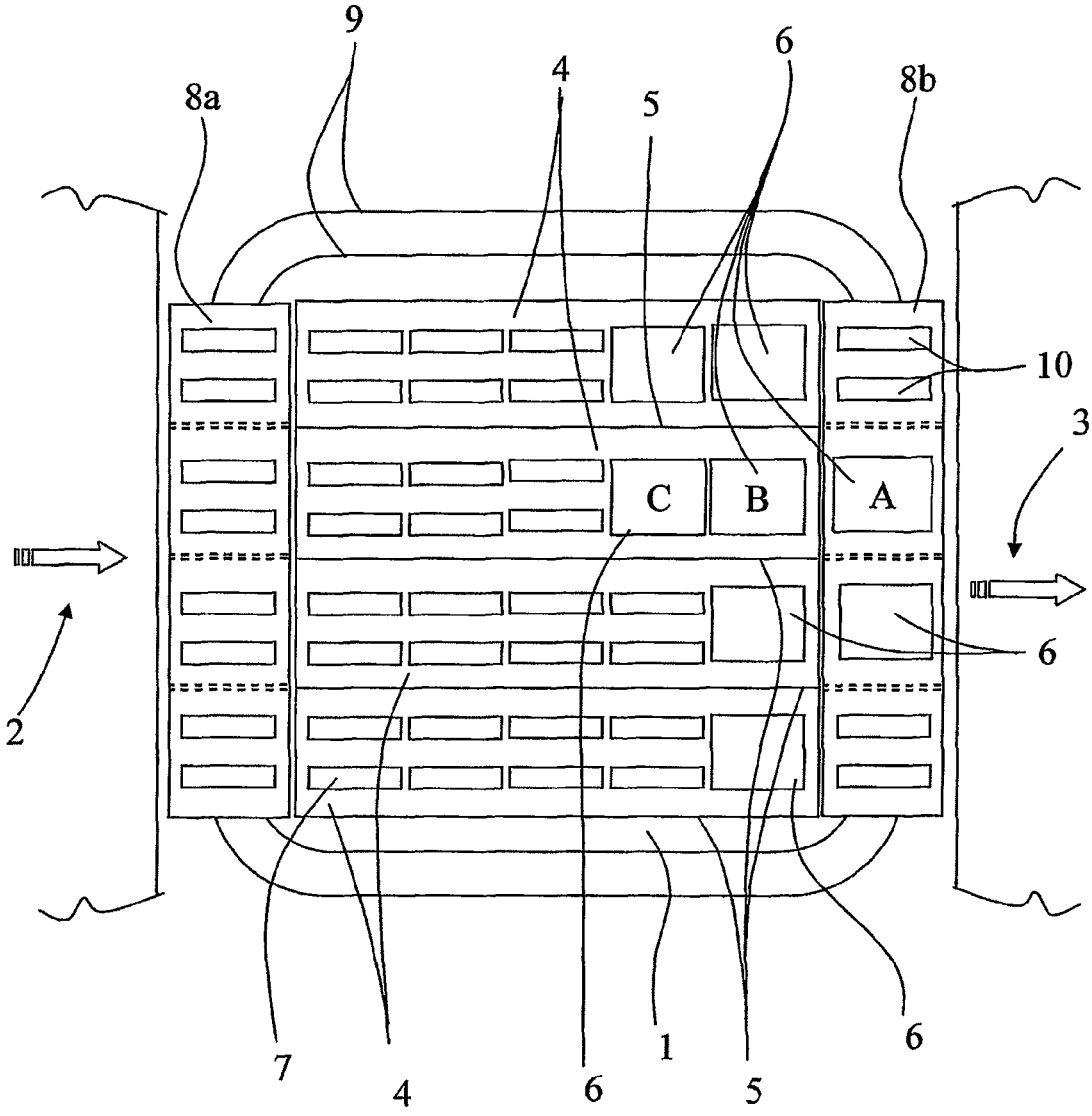
Figure 3:
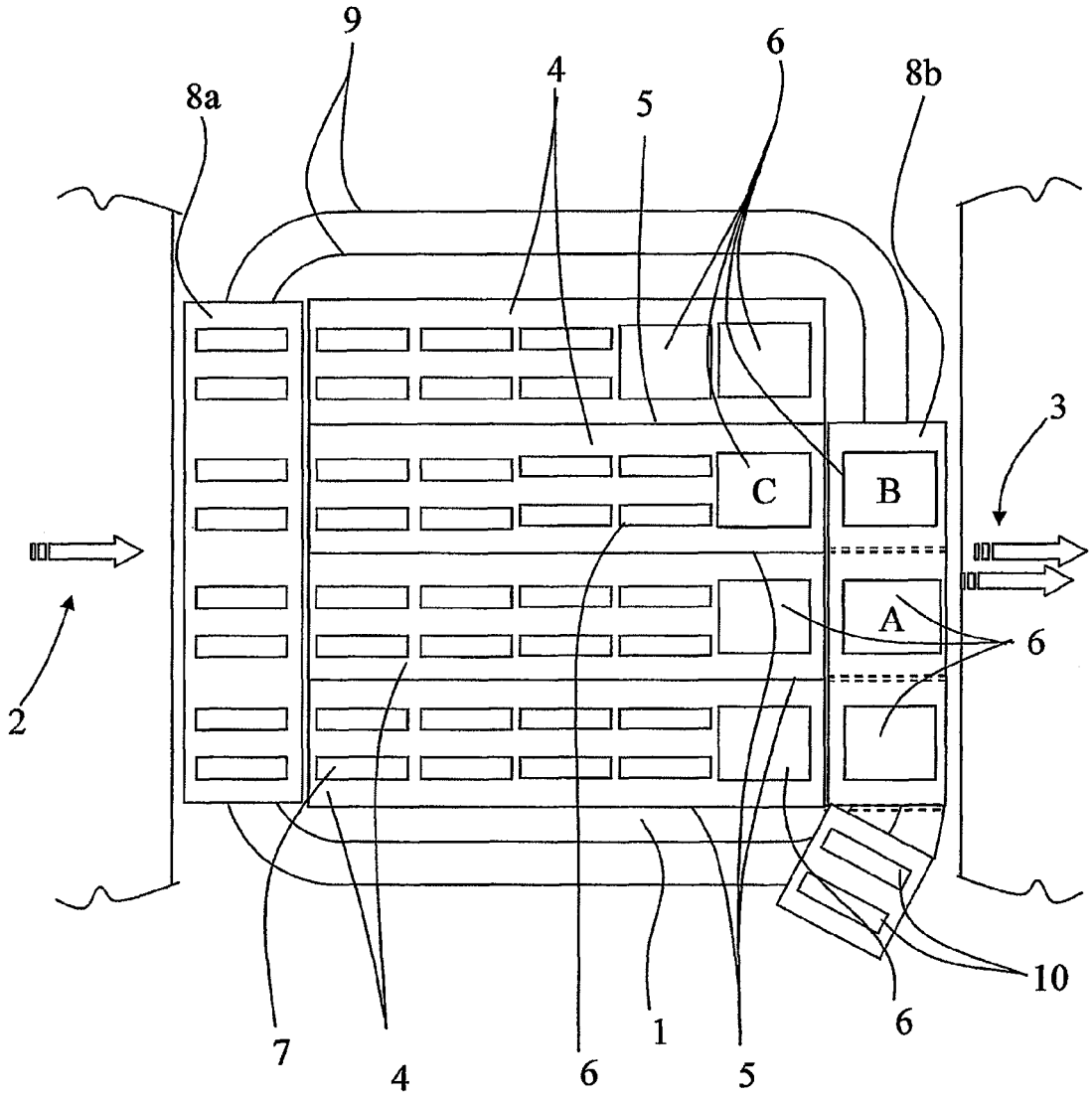
Figure 4:
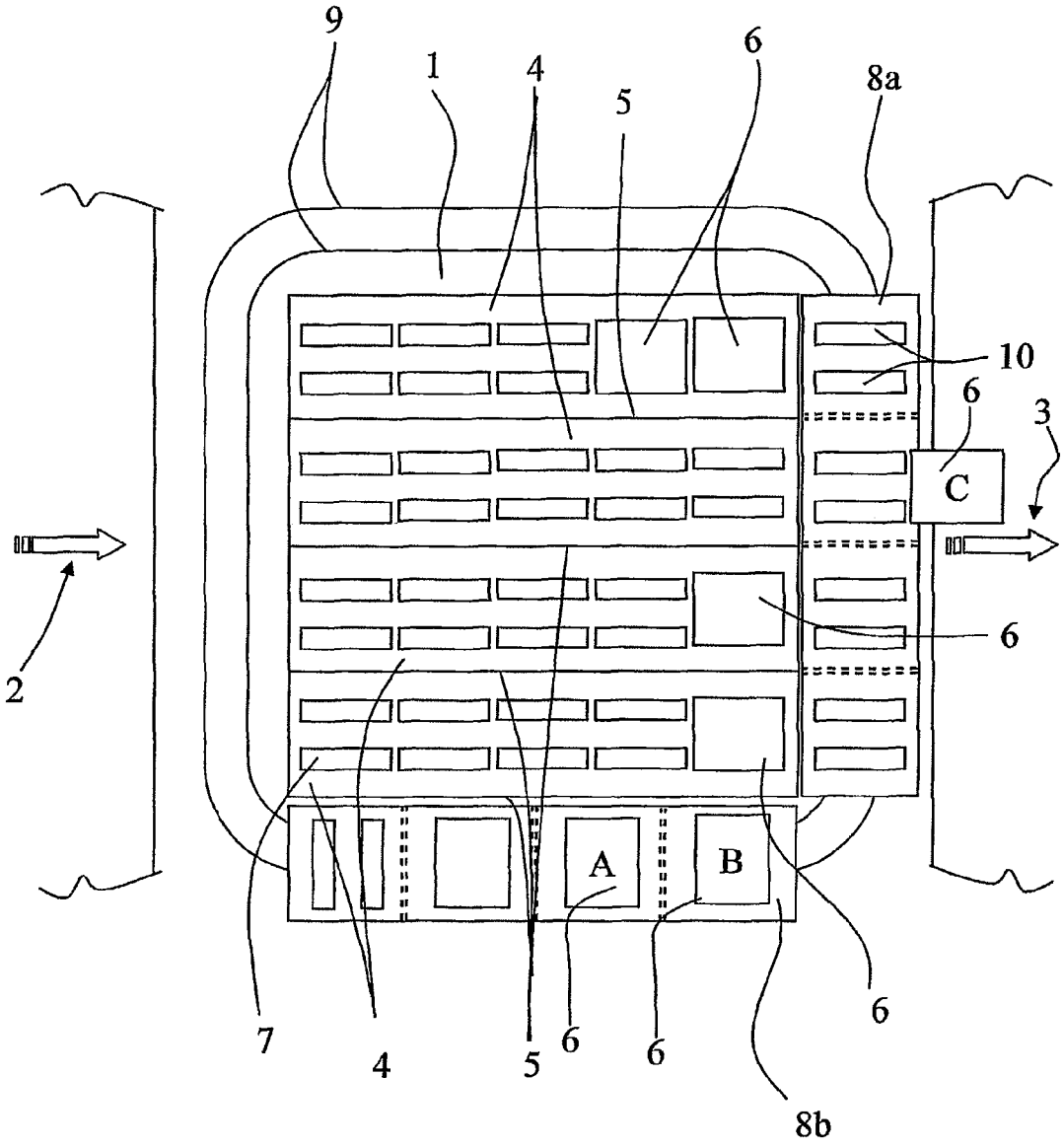
Figure 5:
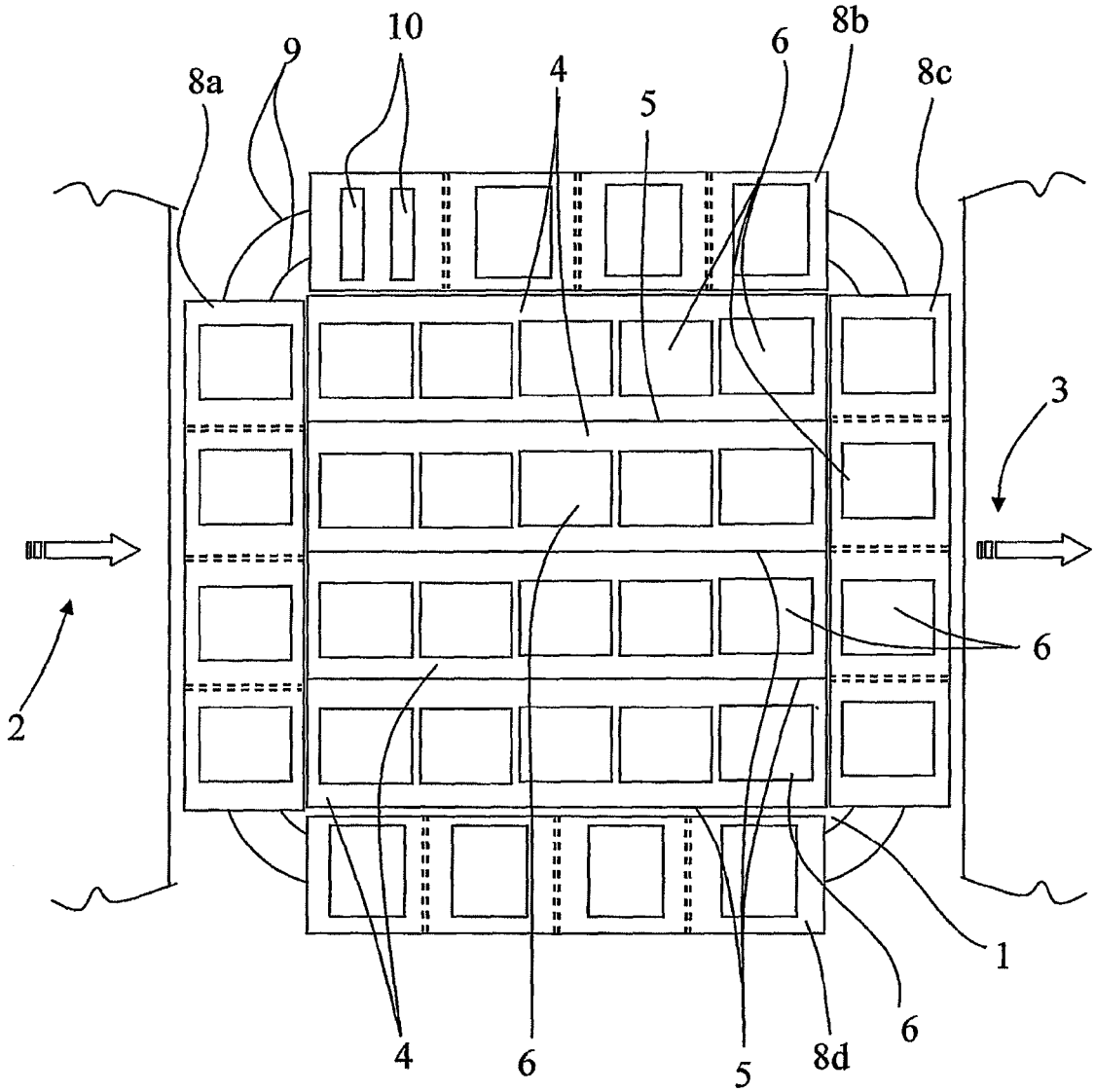
Figure 6:
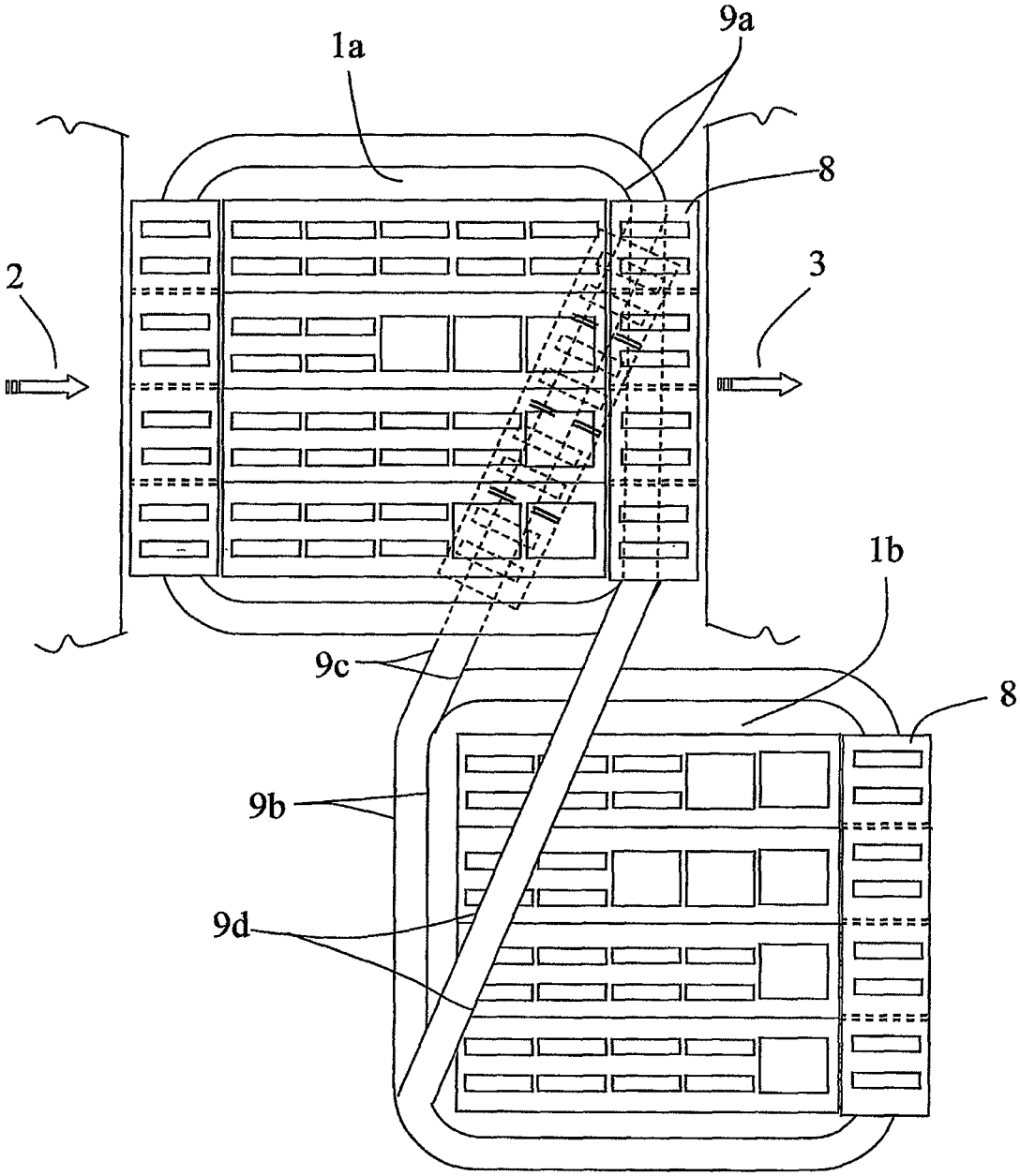
Figure 9A:
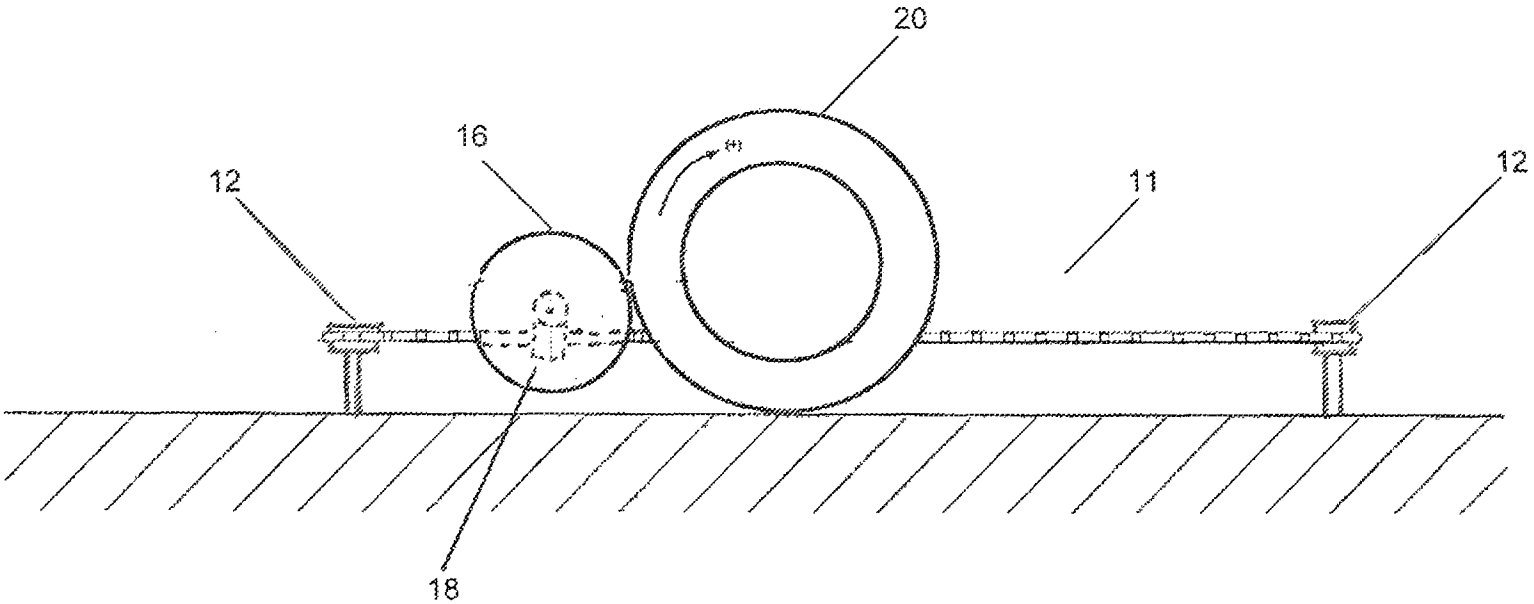
Figure 11:
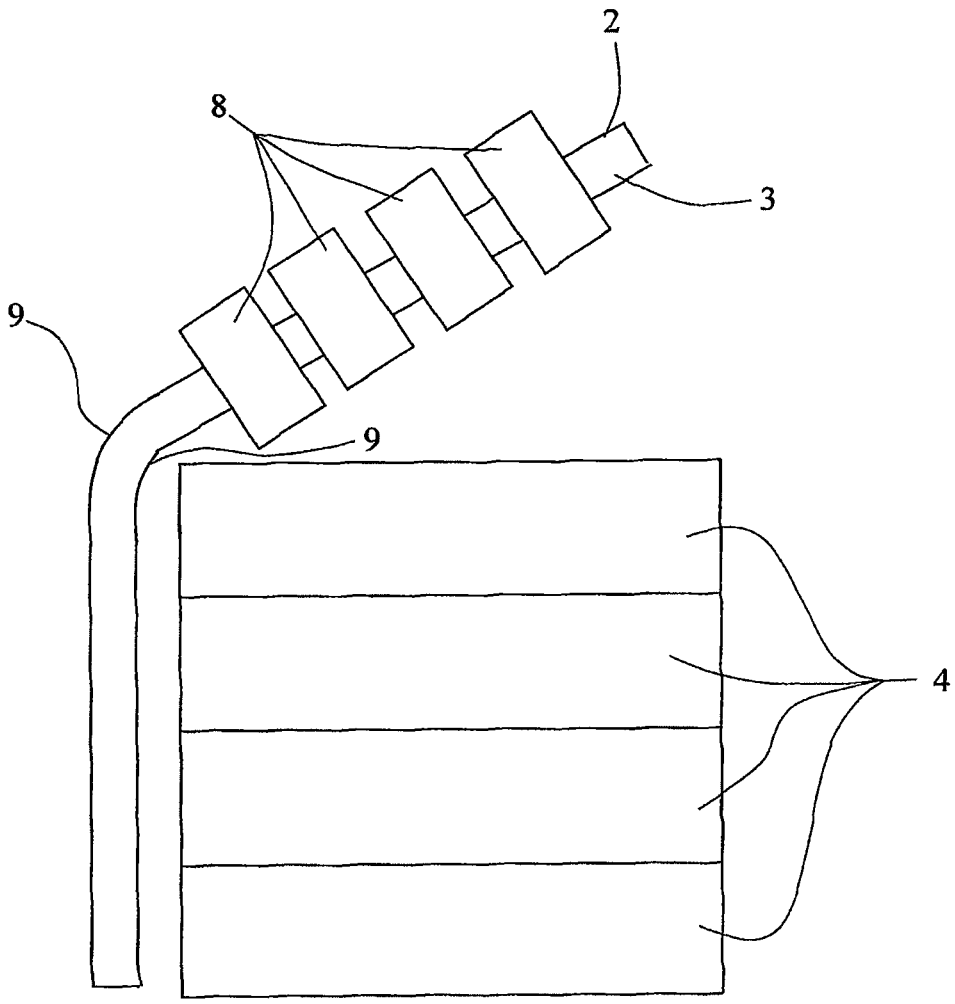
Figure 12:
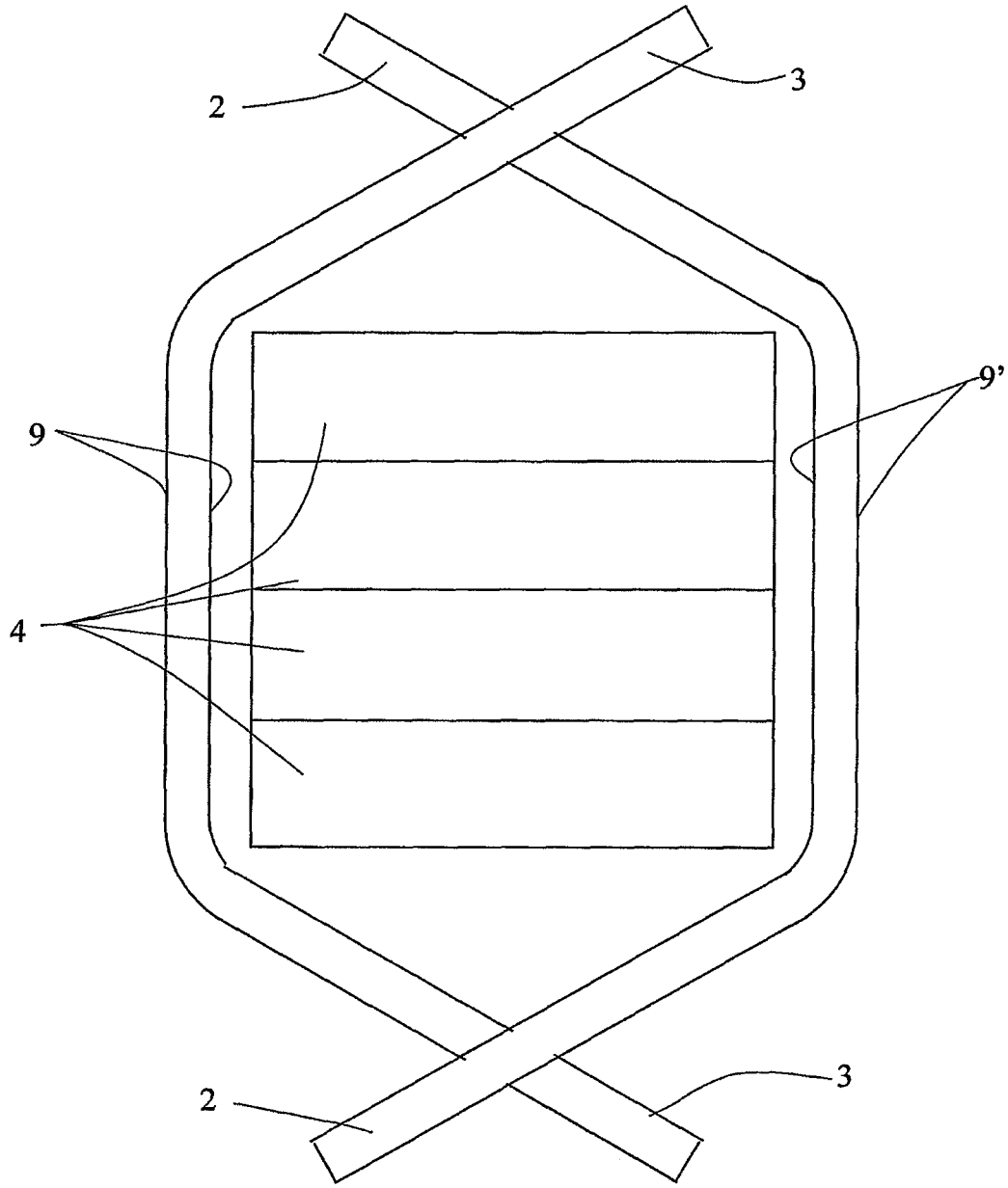

FIG. 1 represents schematically a partially occupied parking garage according to a first two-dimensional embodiment of the invention;

FIGS. 2 to 4 illustrate schematically the method of accessing a vehicle according to a first two-dimensional embodiment of the invention;

FIG. 5 represents schematically the fully occupied parking garage according to the first two-dimensional embodiment of the invention;

FIG. 6 represents schematically a parking garage according to a second three-dimensional embodiment of the invention;

FIG. 7 represents a top schematic view of a variant device for automatic movement of a vehicle in a parking line;

FIG. 8 represents a front view of the device for automatic movement of a vehicle according to the variant of FIG. 7;

FIG. 9 represents a top view of the device for automatic movement of a vehicle according to the variant of FIG. 7;

FIG. 9A represents a side view of the device for automatic movement of a vehicle according to the variant of FIG. 9;

FIG. 10 represents a variant of a device for orienting a vehicle in a parking line;

FIG. 11 represents a variant embodiment of the first mode of execution of the invention of FIG. 1;

FIG. 12 represents a second variant embodiment of the first mode of execution of the invention of FIG. 1.

FIG. 1 illustrates a mode of execution of the parking garage placed on a single floor, on a horizontal and rectangular surface 1. This garage can be accessed via an entrance 2 placed on a first side of the rectangle and the vehicles may exit the garage via an opposite exit 3. The surface 1 is divided into parking lanes 4 corresponding approximately to the width of the widest vehicle admitted. These lanes 4 are delimited by separations 5 that serve as obstacles and as means of guidance for the vehicles 6, placed one after the other in the longitudinal direction of the parking lane, that is to say the front and rear of the vehicle being oriented toward the ends of the parking lane 4. Each parking lane 4 is fitted with automatic driving means 7 of the vehicles 6 in order to guide them to the free location closest to the exit 3 on its parking lane 4. In this mode of execution, this driving means consists in conveyor belts 7 placed one after the other so as to form two virtually continuous lateral lanes on each parking lane 4, the location of these conveyor belts corresponding to the position of the wheels of the vehicles 6.

FIGS. 7 to 9A which will be explained below illustrate a variant device for deriving the vehicles.

According to the invention, the parking lanes are surrounded by a transport means that consists in platforms 8 that can be moved on rails 9, according to the transport means known as the "flat car" making it possible to connect the two ends, entrance and exit, of the parking lanes 4. The entrance of a vehicle into the parking garage is carried out by it being positioned facing one of the parking lanes 4 comprising free spaces. Then, it is moved forward automatically by the driving means 7 which drive it until it makes contact with the last vehicle of the lane or contact with a retractable stop at the end of the lane if it is entirely free. Access to the parking lanes 4 is achieved by a platform 8*a* traversing a free space which serves as a gangway for access to the garage in this configuration, from the entrance 2. The vehicle is left by its driver with the handbrake off and the wheels straight. The rails have been represented in a rectangular shape for reasons of space but may have a more rounded shape in order to make it easier to turn the corners.

According to a variant embodiment, note that the entrance 2 of the vehicles is moved away into a location farther away from the parking garage 1, a vehicle being positioned on a platform 8 at this entrance 2, then taken automatically by this platform 8 up to the parking garage 1 itself. This solution therefore offers the advantage of great flexibility since it is possible to physically separate the infrastructures for access to the parking garage from the garage itself. Similarly, the exit from the garage may also be physically separated from the garage.

FIGS. 2 to 4 illustrate schematically the method of retrieving a vehicle C parked in the third position in its parking lane 4. A free space on a platform 8*b* is placed opposite the end of this parking lane 4 and the driving means 7 drive the first vehicle A to this free space of the platform 8*b*, the vehicle being positioned transversely to the direction of movement of the platform, as is illustrated in FIG. 2. A new free space of the platform 8*b* is again placed opposite this parking lane in order to drive the vehicle B thereto, as illustrated in FIG. 3. The vehicle C then occupies the first position of its parking lane 4, its movement being caused by the driving means 7 of the parking lane. It is then sufficient to again place a free space of a movable platform 8*a* opposite this vehicle C in order to allow it to move forward and cross the space separating it from the exit 3. In this exit phase, the platform 8*a* plays the role of a gangway between the parking garage 1 and the exit 3, and allows the exiting movement of the vehicle with the aid of the driving means of the conveyor belt type 10 that it comprises. Note, if all the spaces on the platforms 8 are occupied, it is possible to reinsert vehicles from these platforms into free spaces of the parking lanes 4 via the entrance side 2. For this, the platform is positioned opposite the entrance of the parking lanes 4 on the side of the entrance 2 of the parking garage, and the driving means 10 of the platform 8 make it possible to automatically drive a vehicle to free spaces of a parking lane 4.

The invention also relates to a method for accessing a space of a parking garage according to the invention thanks to the following steps, explained in detail below:

- automatic driving of the vehicle 6 from the entrance 2 into a parking lane 4;
- positioning of the vehicle in the longitudinal direction in contact with a preceding vehicle or a retractable stop placed at the end of the parking lane 4.

The invention also relates to a method for retrieving a vehicle from a parking garage according to the invention thanks to the following steps, explained in detail below:

- positioning of a free space of a platform 8 at the end of the parking lane 4 where the vehicle 6 to be retrieved is positioned;
- automatic driving and positioning of the first vehicle of the parking lane 4 on this platform 8;
- repetition of the above two steps until the vehicle to be retrieved is positioned on a platform 8;
- transport of the vehicle 6 to be retrieved by the platform 8 to the exit 3 of the parking garage.

FIG. 5 illustrates a variant execution of this first mode of execution of the invention, comprising a multitude of platforms 8*a*, 8*b*, 8*c*, 8*d*, in a maximum filling configuration.

Finally, the solution described above satisfies the objects of the invention because it has the following advantages:

- in each parking lane, the vehicles can be placed one against the other in a longitudinal direction, without wasting space between the vehicles, according to a solution independent of the variable length of the vehicles;
- the parking lanes have a width that is slightly greater than the maximum authorized width. Since almost all the vehicles have substantially equivalent widths, very little surface area is wasted between the vehicles and the lateral limits 5 of each parking lane 4, irrespective of the vehicle type;
- the means for driving the vehicles in the parking lanes are simple and the solution is not very costly, since this driving is based on setting in motion the vehicle's own wheels, with no intermediate truck or platform;
- the means for moving the vehicles around the garage are also relatively simple and also fulfill the second function of additional parking spaces.

The same concept may be applied to three-dimensional configurations, that is to say to parking garages consisting of several floors, each floor having a structure similar to the mode of execution described above. In the exemplary embodiment illustrated in FIG. 6, the parking garage consists of an upper floor 1*a* comprising the entrances 2 and exits 3 of the parking garage and a lower floor 1*b*. Each floor is surrounded by movable platforms 8 mounted on rails 9, these rails also forming an up ramp 9*c* and a down ramp 9*d*, in order to automatically move vehicles from the lower floor to the upper floor and vice versa. These ramps connect the closed circuits 9*a* and 9*b* respectively of the upper floor la and lower floor 1*b*, allowing the platforms to circulate around these floors. Switches are provided at the junction between the ramps 9*c* and 9*d* and the closed circuits 9*a* and 9*b*. This three-dimensional configuration naturally makes it possible to provide more parking spaces on a reduced ground surface area. The parking spaces of the lower floor 1*b* are filled by the vehicles being guided by a platform 8, taking the down ramp 9*d* from the upper floor 1*a*, being positioned on the rails 9*b* along the side facing the entrance of the parking lanes 4 of the lower floor 1*b*. Then the vehicles are positioned in this parking lane by the driving means 10 of the platform then by the driving means 7 of the parking lane. A vehicle is returned to the exit by repositioning it on the platform 8, according to a method similar to that described with reference to FIGS. 2 to 4, then by raising it to the exit 3 on the upper floor 1*a* by taking the up ramp 9*c*.

The whole parking garage may be managed by a software program on a central server, storing the positioning of each vehicle parked in the garage, computing according to the best possible algorithm the movements of the platforms in order to optimize the distribution of the vehicles and the method for retrieving vehicles.

FIGS. 7 to 9A illustrate a variant driving device 7 of the vehicles within the parking lanes 4 and on the platforms 8, allowing the vehicles to move on their own wheels 20. The driving device is based in driving cables 11 positioned on the center of each parking lane 4 and set in motion by pulleys 12 positioned at the ends of the lanes. This device also comprises a double rail 13, distributed either side of the driving cable 11 and approximately 30 centimeters apart.

This device allows the driving of a rider which interacts with a motor vehicle to set it in motion. A rider comprises a chassis with four wagon wheels 14 traveling on the rails 13, incorporating a braking device and external wheels 15, connected to the wheels 14 by a drive roller 16. The outer wheels 15 are capable of adjusting the height of the drive roller 16 relative to the ground. The rider is finally set in motion in a chosen direction by a pair of hydraulic calipers 17, whose operation is similar to that of disk brake calipers, which lower like a rider on a cable 11 corresponding to the chosen direction.

The drive rollers 16 interact directly with the wheels 20 of a motor vehicle. For this, they are advantageously fluted and rotated in the direction contrary to the sought rotation of the wheels of the vehicle, by means of a shuttle-shaped roller 18 that interacts with the cable 11 going in the direction opposite to that of the vehicle.

The drive rollers 16 in contact with the wheels 20 of the vehicle impose thereon a rotary motion, in the direction opposite to that of the rollers 16, by the tangential force of contact that is added to the driving force itself. This combination of driving and rotation forces makes it possible to set the vehicle in motion gently, particularly in a startup phase.

To fulfill their function of driving the motor vehicles, a rider is placed under each vehicle. For that, a free rider is placed on the platform 8 at the entrance 2 of the parking garage, in a slight depression of its rail 13. A vehicle arriving in the garage will therefore be positioned above the rider so that the rider is placed between the two front and rear axles of the vehicle. This interaction between the rider and the vehicle will last throughout the parking of the vehicle within the parking garage, whether it is positioned in a parking lane 4 or on a platform 8. The vehicle will therefore be set in motion by an interaction of the rider with a driving cable 11. The rider associated with a vehicle may serve as an identification of the vehicle for managing the position of the vehicles, access to the free spaces and their retrieval.

As a variant, the association of a vehicle with a rider could be organized upstream of the platforms 8, in specific entrance boxes where the drivers would collect or leave their vehicles.

As a comment, a vehicle is moved from a platform 8 to a parking lane 4 by setting the rider in motion initially on the platform 8, its front caliper 17 latching onto the cable 11 of the platform 8 when it reaches its end, the vehicle then being moved by the rear caliper 17 again in interaction with the cable 11 of the platform until the front caliper 17 arrives in interaction with the cable 11 of the parking lane 4. Then, the rear caliper 17 is also separated from the cable of the platform 8 to take hold of the cable of the parking lane. The same principle is used for the inverse movement of a vehicle from a parking lane to a platform. Vertically retractable bollards may be provided at the ends of the platforms 8 and of the parking lanes 4. On the platforms 8, this bollard may serve as a stop indicating the correct positioning of a vehicle, particularly relative to its rider, the rollers then coming into contact with the vehicle wheels.

One advantage of this principle therefore arises from the fact that a motor vehicle moves on its own wheels in the parking lanes and may come directly into contact with the preceding vehicle, which best optimizes the park space. Therefore, there is no need for a complex structure for setting in motion a platform in the whole parking garage, supporting a vehicle that is passively immobile on this platform. Platforms are used only over a small surface area, partially surrounding a set of parking lanes.

There are many variant embodiments of a driving device as described in FIGS. 7 to 9. For example, this device may be simplified by removing the rotary movement of the drive rollers 16 and therefore the shuttles 18. In addition, the movement of the riders will be controlled by intelligent electronic devices, taking into particular account the length of the vehicles in order to optimize their positioning. In addition, a device making it possible to adjust the width of the lanes may be implemented in order to be able to adapt the garage to a change in the dimensions of the vehicles to be parked. For this, the vehicles could be placed in the parking lanes on traffic lanes consisting of movable plates, being able more or less to be superposed in order to reduce or increase the width of the lane.

According to an advantageous option, a trajectory correction device may be used, as illustrated in FIG. 10. Specifically, since the motor vehicles move on their own wheels, it is important for their wheels to be very straight in order to obtain a sufficiently rectilinear trajectory. For this, a slight deviation in trajectory may be corrected by placing at regular intervals strips of conveyor belt 19 spaced perpendicularly to the longitudinal direction of the parking lanes in order to cause a transverse movement of the wheels of a vehicle in order to recenter it if necessary.

According to an advantageous variant embodiment of a parking garage according to the concept of the invention, it is possible to envisage the movement of the platforms 8 on rails 9 in two opposing directions, and the movement of the vehicles within a parking lane in both directions. Such a variant makes it possible to reduce the obligatory distance of the rails 9, and makes it possible to increase the possibilities of managing the vehicles for one and the same rail distance. Specifically, since the platforms 8 may move in both directions on the rails 9, there is no obligation to produce a closed circuit. This makes it possible to provide a single entrance/exit door instead of two doors, one for entering and the other for exiting. In the case of a garage with several floors, a single ramp is sufficient for the movement from one floor to another. This variant also makes it possible to optimize the methods for accessing the parking spaces and for retrieving the vehicles. Specifically, if a vehicle is on a platform 8 close to one end of the rails 9, it is not necessary to make it travel along all of the rails 9 to reach the exit but, on the contrary, a short movement in the reverse direction is possible. This variant therefore makes it possible to reduce the distance traveled by a vehicle. As a comment, the use of two calipers at the front and at the rear of the vehicle in the embodiment of movement with the aid of riders, as described previously with reference to FIGS. 7 to 9, allows this movement of the vehicle in the two opposing directions.

FIG. 11 illustrates a first application of such a variant according to a two-dimensional diagram. In this solution, the rails 9 extend only over one side of the parking lanes 4, and comprise an end 2, 3 which fulfills the functions of both vehicle entrance and exit.

FIG. 12 illustrates a second application of such a variant in which the parking lanes 4 are surrounded by two circuits of independent rails 9, that may cross. Such a layout makes it possible to offer two entrance/exit zones 2, 3 of the garage and increases the possibilities of movement of a vehicle.

According to another application not shown, the rails 9 could make a complete circuit of the parking garage, switches being implemented to choose the direction to an entrance/exit 2, 3 or the movement around the parking garage.

Finally, this concept may be applied in parking garages occupying several floors, the ramps then playing the combined role of up and down ramp. This therefore makes it possible to reduce by half the number of ramps and greatly simplify the overall structure.

The invention claimed is:

1. A vehicle parking garage that is at least partially automatic, comprising at least one floor comprising parking lanes separated by lateral limits wherein each parking lane comprises a first driving means for directly driving in rotation the wheels of a vehicle on the at least one floor in order to move the vehicle in the longitudinal direction up to a free space and in that entrance or exit ends of the parking lanes are connected to a transport means consisting of one or more platforms traversing a second free space between an entrance or exit and the parking lanes, the platforms traveling on rails spaced apart and separate from the parking lanes allowing the vehicles to automatically enter and exit the parking lanes, at least one floor being at least partially surrounded by rails, wherein each platform comprises a second driving means adapted to drive the vehicle to the free space of a parking lane or to drive the vehicle in an exiting movement.

2. The parking garage as claimed in claim 1, wherein at least one floor is totally surrounded by the rails to allow several platforms to travel around the at least one floor.

3. The parking garage as claimed in claim 1, wherein the platforms are able to move in the two opposing directions on the rails and in that the vehicles are able to move in the two opposing directions within the parking lanes.

4. The parking garage as claimed in claim 1, wherein each platform comprises one or more parking space(s) for receiving one or more vehicle(s), transversely to the direction of movement of the platform.

5. The parking garage as claimed in claim 1, wherein the second driving means of each platform is adapted for setting a vehicle in motion.

6. The parking garage as claimed in claim 5, wherein the first driving means of the parking lanes and the second driving means of the platforms comprise a rider set in motion on rails by means of driving cables.

7. The parking garage as claimed in claim 6, wherein the rider comprises calipers for interacting with the driving cables and a roller for exerting a driving force on the wheels of a vehicle.

8. The parking garage as claimed in claim 7, wherein the rider also comprises a shuttle for rotating the roller in order to exert a tangential rotational force on the wheels of a vehicle.

9. The parking garage as claimed in claim 1, wherein a platform plays the part of a gangway between the entrance and/or the exit of the parking garage.

10. The parking garage as claimed in claim 1, wherein each parking lane is configured to accept the width of the widest vehicle admitted into the parking garage.

11. The parking garage as claimed in claim 1, wherein it comprises at least two floors and a transport means allowing the transport of the vehicles from one floor to another, and access to the parking lanes of each floor.

12. The parking garage according to claim 1, wherein the parking garage comprises a parking lane where two vehicles are placed one against the other in a longitudinal direction, optimizing the park spaces.

13. The parking garage according to claim 1, wherein a parking lane comprises regularly spaced strips of conveyor belt oriented perpendicular to the longitudinal direction of the parking lanes, the conveyor belts adapted to cause transverse movement of the wheels, wherein the transverse movement of the wheels centers the vehicle within the lane, correcting deviations in rectilinear trajectory.

14. A vehicle parking garage that is at least partially automatic, comprising at least one floor comprising parking lanes separated by lateral limits wherein each parking lane comprises a first driving means for directly driving in rotation the wheels of a vehicle on the floor in order to move the vehicle in the longitudinal direction up to a free space and in that entrance or exit ends of the parking lanes are connected to a transport means consisting one or more platforms traversing a second free space between an entrance or exit and the parking lanes, the platforms traveling on rails spaced apart and separate from the parking lanes allowing the vehicles to automatically enter and exit the parking lanes, at least one floor being at least partially surrounded by rails, wherein each platform comprises a second driving means adapted to drive the vehicle to the free space of a parking lane or to drive the vehicle in an exiting movement, and wherein the first and/or the second driving means comprises a conveyor belt wherein the parking garage comprises at least two floors and a single ramp for moving from one floor to the other, on which the platforms are capable of movement in the two opposing directions.

15. A vehicle parking garage that is at least partially automatic, comprising at least one floor comprising parking lanes separated by lateral limits wherein each parking lane comprises a first driving means for directly driving in rotation the wheels of a vehicle on the at least one floor in order to move the vehicle in the longitudinal direction up to a free space and in that entrance or exit ends of the parking lanes are connected to a transport means consisting of one or more platforms traversing a second free space between an entrance or exit and the parking lanes, the platforms traveling on rails spaced apart and separate from the parking lanes allowing the vehicles to automatically enter and exit the parking lanes, at least one floor being at least partially surrounded by rails, wherein each platform comprises a second driving means adapted to drive the vehicle to the free space of a parking lane or to drive the vehicle in an exiting movement.

* * * * *